US006922348B2

(12) United States Patent
Nakajima et al.

(10) Patent No.: US 6,922,348 B2
(45) Date of Patent: Jul. 26, 2005

(54) WATER SUPPLY

(75) Inventors: Kaoru Nakajima, Tokyo (JP); Kenichi Kajiwara, Tokyo (JP); Masahito Kawai, Tokyo (JP); Masahiko Kishi, Tokyo (JP); Nobuhiro Higaki, Tokyo (JP); Yukio Murai, Tokyo (JP)

(73) Assignee: Ebara Corporation, Tokyo (JP)

( * ) Notice: Subject to any disclaimer, the term of this patent is extended or adjusted under 35 U.S.C. 154(b) by 110 days.

(21) Appl. No.: 10/332,197

(22) PCT Filed: Jul. 5, 2001

(86) PCT No.: PCT/JP01/05833

§ 371 (c)(1),
(2), (4) Date: May 19, 2003

(87) PCT Pub. No.: WO02/04813

PCT Pub. Date: Jan. 17, 2002

(65) Prior Publication Data

US 2003/0174450 A1 Sep. 18, 2003

(30) Foreign Application Priority Data

Jul. 7, 2000 (JP) ..... 2000-206561
Dec. 22, 2000 (JP) ..... 2000-391557

(51) Int. Cl.[7] ..... H02M 3/24

(52) U.S. Cl. ..... 363/95; 363/97; 323/906; 318/801

(58) Field of Search ..... 307/44, 61, 87, 307/80, 85; 323/222, 299, 906, 303; 363/95, 97, 130, 135, 137; 417/18, 44, 45, 53, 12, 63; 318/430, 807, 805, 729

(56) References Cited

U.S. PATENT DOCUMENTS 4,370,098 A * 1/1983 McClain et al. ..... 417/18
4,494,180 A 1/1985 Streater et al.
4,916,382 A 4/1990 Kent
5,654,883 A 8/1997 Takehara et al.
5,767,654 A 6/1998 Menegoli et al.
5,883,489 A * 3/1999 Konrad ..... 318/807
5,909,061 A * 6/1999 Sasaki et al. ..... 307/44

FOREIGN PATENT DOCUMENTS

| | | |
|---|---|---|
| JP | 60-249682 | 12/1985 |
| JP | 63-71485 | 5/1988 |
| JP | 6-230838 | 8/1994 |
| JP | 7-63170 | 3/1995 |
| JP | 8-95655 | 4/1996 |
| JP | 8-101723 | 4/1996 |
| JP | 8-238031 | 9/1996 |
| JP | 8-338391 | 12/1996 |
| JP | 10-191684 | 7/1998 |
| JP | 11-146685 | 5/1999 |
| JP | 11-308893 | 11/1999 |

* cited by examiner

*Primary Examiner*—Rajnikant B. Patel
(74) *Attorney, Agent, or Firm*—Wenderoth, Lind & Ponack L.L.P.

(57) ABSTRACT

According to the present invention, in a water supply apparatus which converts output power of a solar cell with an inverter to drive a motor pump for pumping up water, a DC brushless motor having no sensor for detecting a position of a rotatable shaft is used as a motor for driving the pump. Further, the water supply apparatus, having a pump and a frequency converter for supplying electric power to the pump and controlling a rotational speed of the pump, includes a standard current value table in which rotational frequencies of the pump and standard current values as criteria for shutoff operation at the rotational frequencies are associated with each other, a rotational frequency detecting device for detecting a rotational frequency of the pump, a standard current value acquiring device for acquiring a standard current value corresponding to the rotational frequency detected by the rotational frequency detecting device with reference to the standard current value table, a current detecting device for detecting a current value supplied to the pump, and a comparing device for comparing the current value detected by the current detecting device with the standard current value acquired by the standard current value acquiring device.

20 Claims, 6 Drawing Sheets

WATER SUPPLY

This application is a National Stage of International Application No. PCT/JP01/05833, filed Jul. 5, 2001.

TECHNICAL FIELD

The present invention relates to a water supply apparatus having a pump operated at variable speeds with a frequency converter such as an inverter, and more particularly to a water supply apparatus for converting output power of a solar cell with an inverter, and supplying this electric power to a motor pump disposed at a bottom of a well or the like to pump up water.

BACKGROUND ART

A method of converting an output voltage of a solar cell with an inverter and supplying this converted power to a pump apparatus or the like allows feeding of water, irrigation, and the like to be performed even in regions in which stable electric power cannot easily be supplied, such as intermontane regions, and thus is highly useful for such regions. In such regions, it can be considered that water may be pumped up from a well or the like with use of an engine pump or the like. However, the engine pump requires fuel to be supplied thereto, which is inconvenient. Specifically, in such a system using an engine pump or the like, if supply of fuel is stopped, then it may be considered that feeding of water is also stopped. In contrast thereto, a system utilizing a solar cell as an energy source does not need fuel to be supplied thereto, and is highly convenient because water can be pumped up as long as sunlight is applied to the solar cell.

This type of water supply apparatus comprises a solar cell for converting sunlight into electric energy, an inverter for converting direct-current power supplied from the solar cell into alternate-current power suitable for operation of a pump, a motor for driving a rotatable shaft while being supplied with electricity from the inverter, and a pump driven by the motor. Generally, a motor pump for pumping up water is disposed at a bottom of a deep well or the like to pump up water, and the pumped water is stored in a tank on the ground. Such a pump utilizing a solar cell is operated by electric power produced in accordance with an amount of solar radiation. Since the pumped water is stored in the tank, the water can be used as needed.

A submerged pump is generally used as the pump in the above system, a three-phase induction motor is generally used as the motor for driving the pump, and an inverter supplies alternating-current power to the motor. Electric energy supplied from the solar cell varies depending on the amount of solar radiation and operating conditions of the motor pump (e.g., voltage, current, and frequency). Therefore, a maximum electric power tracking control in which the voltage, the current, and the frequency are controlled so as to supply the maximum electric power to the pump is performed to operate the pump most efficiently.

The following are required for such a water supply apparatus utilizing a solar cell. First, in order to utilize solar energy efficiently, it is necessary to maximize efficiency of the entire system. Further, since the pump is disposed within a well or the like, the pump needs to be small and lightweight, to be strong, and to have little trouble. The pump should be capable of being easily handled so that an operator who operates the pump can operate the pump with ease. Furthermore, it is necessary to protect the pump sufficiently, for example, to prevent the pump from racing due to water shortage in the well, or to output an alarm in advance and stop the pump when trouble is detected which would cause the pump to be damaged.

In order to enhance efficiency of a motor pump, it has heretofore been considered that a high-efficiency DC brushless motor should be used as the motor in the motor pump. A DC brushless motor controls currents supplied from an inverter to windings by switching the currents according to a rotational angle of a rotatable shaft. Specifically, the DC brushless motor supplies the currents to the windings of the motor sequentially in accordance with a detected rotational angle of the rotatable shaft to thereby rotate the rotatable shaft. Generally, the rotational angle of the rotatable shaft is detected with use of a magnet fixed to a portion of the rotatable shaft and a position sensor such as a Hall element for detecting the position of the magnet. Thus, it is necessary to provide the position sensor for detecting the rotational angle of the rotatable shaft, a sensor circuit with the sensor, sensor wires for transmitting the rotational angle of the rotatable shaft to the inverter, and the like.

However, since the motor pump is disposed at the bottom of a well or the like, as described above, a system using a sensor such as a Hall element is not suitable for a submerged pump installed in a well because of the increased number of wires. Further, when the number of parts, such as a sensor element and a sensor amplifier, increases, a possibility of trouble increases accordingly, resulting in necessity of maintenance. In order not to expose such sensor wires to an exterior, the sensor wires and the inverter may be installed in a casing of the motor. However, if the inverter is disposed in the casing of the motor, then space is required for the motor itself and a structure of the motor pump itself becomes complicated. Thus, maintenance burdens become greater.

Further, such a water supply apparatus requires a controller for controlling starting and stopping of the motor pump and outputting signals to an external device. Since an inverter generally includes such a controller therein, it is necessary to separate the controller and the inverter from each other, which is inconvenient. Further, it is feared that water may enter an interior of the motor, and, if the inverter is not installed in a good environment, then it becomes necessary to pull up the pump from the well in order to handle any trouble with the inverter. Thus, many problems arise in view of maintenance as well. Therefore, when maintenance is taken into consideration, it is desirable to dispose a portion of the inverter on the ground.

SUMMARY OF INVENTION

The present invention has been made in view of the above drawbacks, and it is therefore an object of the present invention to provide a water supply apparatus utilizing a solar cell which has less trouble, needs less maintenance, and can be operated stably for a long time.

Another object of the present invention is to provide a water supply apparatus which can continuously be operated while preventing its pump from shutting off.

According to an aspect of the present invention, there is provided a water supply apparatus utilizing a solar cell which converts output power of the solar cell with an inverter to drive a motor pump for pumping up water, wherein the water supply apparatus is characterized in that a DC brushless motor having no sensor for detecting a position of a rotatable shaft is used as a motor for driving the pump.

Since a DC brushless motor having no sensor for detecting a position of a rotatable shaft is used as a motor for driving the pump, excessive sensor wires are not necessary.

Accordingly, much less trouble is caused in a sensor portion, and the pump can easily be installed. Further, structure of the DC brushless motor can be made simple, and less trouble is caused in the DC brushless motor. With the DC brushless motor, a high efficiency is achieved in the motor, thereby utilizing solar energy efficiently. Further, the motor pump can be rotated at a high speed with inverter control, and hence the motor pump can be made small in structure. Therefore, the pump can easily be installed within a narrow space such as a well, and the water supply apparatus can easily be constructed.

According to another aspect of the present invention, there is provided a water supply apparatus having a pump and a frequency converter for supplying electric power to the pump and controlling a rotational speed of the pump, wherein the water supply apparatus is characterized by comprising: a standard current value table in which rotational frequencies of the pump and standard current values as criteria for performing a shutoff operation at the rotational frequencies are associated with each other; rotational frequency detecting means for detecting a rotational frequency of the pump; standard current value acquiring means for acquiring a standard current value corresponding to the rotational frequency detected by the rotational frequency detecting means with reference to the standard current value table; current detecting means for detecting a current value supplied to the pump; and comparing means for comparing the current value detected by the current detecting means with the standard current value acquired by the standard current value acquiring means.

In this case, the pump may be stopped when it is judged that the current value detected by the current detecting means is lower than the standard current value. Further, the pump may be stopped after a certain period of time elapses.

According to the present invention, since a shutoff operation can be detected during operation of the pump to thereby stop the pump, it is possible to prevent the pump from being damaged by overheating due to performance of the shutoff operation.

DETAILED DESCRIPTION OF THE PREFERRED EMBODIMENTS

An embodiment of the present invention will be described below with reference to the accompanying drawings.

Figure 1:
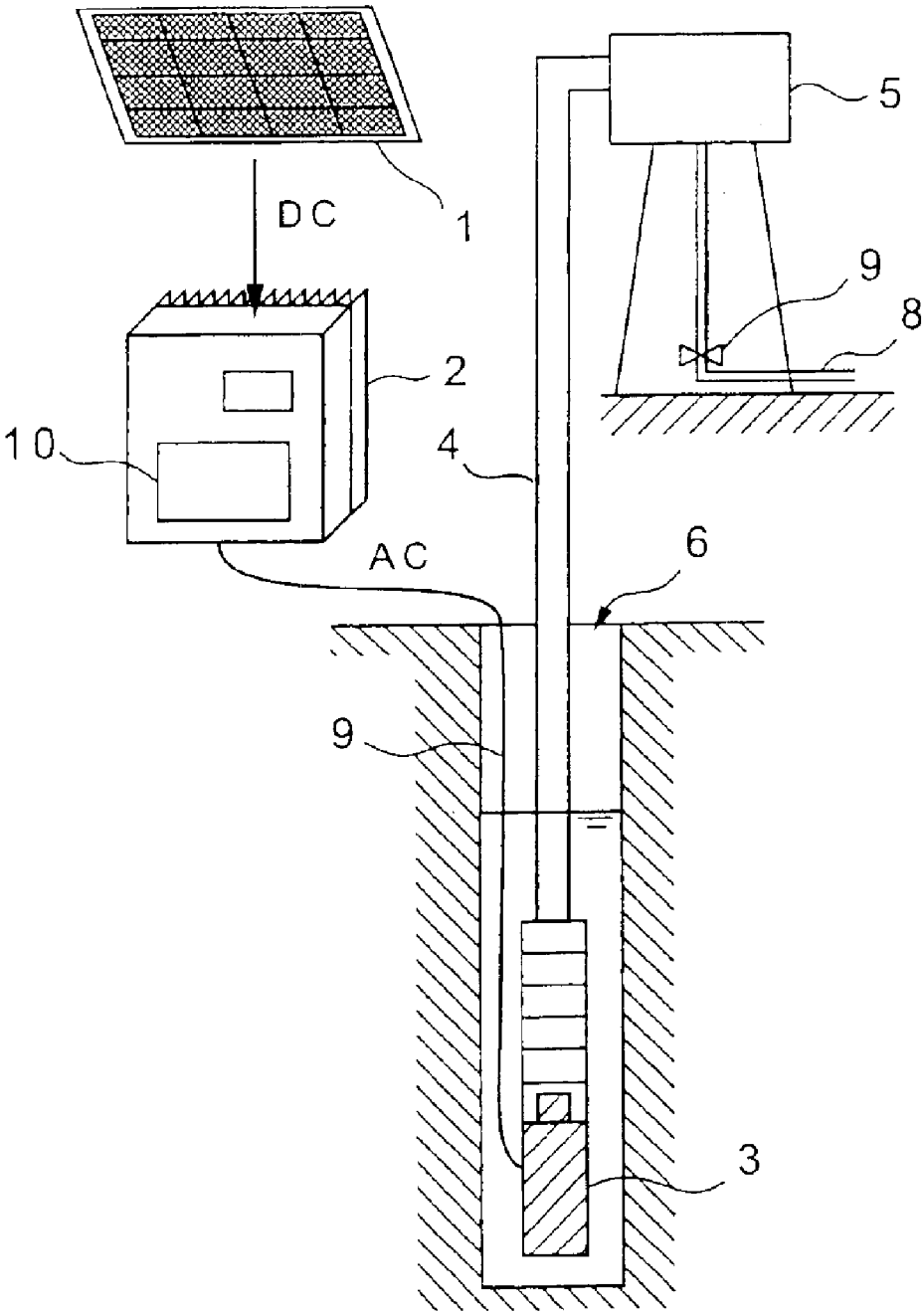
FIG. 1 is an explanatory view of a water supply apparatus utilizing a solar cell according to an embodiment of the present invention.

FIG. 1 is a schematic view showing an entire arrangement of a water supply apparatus utilizing a solar cell according to the present invention. A solar cell 1 converts solar energy into electric energy and applies a direct-current voltage of about 100 V to about 175 V to an inverter 2. The inverter 2 converts direct-current power supplied from the solar cell 1 into alternating-current power with pulse-width modulation and supplies the alternating-current power to a motor pump 3. The motor pump 3 comprises a pump driven by a DC brushless motor having no sensors. Further, the inverter 2 has a controller with a function for operating the motor without any sensors, a function for tracking control of maximum electric power points, an automatic setting function, an electrically protecting function, a function for preventing the pump from racing, and the like.

The motor pump 3 comprises a submerged motor pump into which a pump and a canned motor are integrally combined with each other. The motor pump 3 pumps water in a well 6 through a discharge pipe 4 up to a water storage tank 5 disposed on the ground. Water stored in the water storage tank is supplied through a pipe 8 to desired regions by opening a valve 9. The inverter 2 supplies an operating frequency up to a maximum of 240 Hz to the motor pump 3, which operating frequency is considerably higher than a frequency of 50 Hz or 60 Hz as used in usual commercial power supply. Thus, a rotational speed of the motor pump is increased, and dimensions of the motor pump itself can be reduced. A system utilizing a solar cell essentially requires an inverter as a power supply for necessarily outputting direct current. Accordingly, an inverter used as a power supply for outputting alternating-current power can be utilized directly for increasing an operating speed of a pump, and hence the pump can be made so small in size as to be suitable for a purpose of disposing the pump in a narrow well. The DC brushless motor is designed to be operated at a rated voltage of about 80 V so as to correspond to output from the solar cell.

The controller 10 disposed within the inverter 2 has a program for driving the DC brushless motor which has no independent sensor such as a Hall element sensor. Specifically, in this motor, a current to be supplied to three-phase windings of the motor is switched in accordance with timing of rotation of a rotatable shaft. Timing signals for switching are not detected with an external sensor such as a Hall element sensor, but are detected by calculating a rotational angle of the rotatable shaft based on states of counter-electromotive forces produced in the motor windings themselves. More specifically, in a control process in which the motor windings themselves are utilized for detecting the rotational angle of the rotatable shaft, the rotational angle of the rotatable shaft is detected based on a correlation between voltages to be applied to the windings of the motor and counter-electromotive forces. The inverter 2 may have a sensor therein for detecting the counter-electromotive forces. The DC brushless motor using no independent sensor requires no sensor such as a conventional Hall element sensor, no sensor circuit for amplifying an output from the sensor, and no sensor wires for transmitting an output from a sensor circuit to the inverter. That such wiring is not necessary is considerably favorable for a submerged pump in a well, which is installed in a narrow well and requires much labor for maintenance therearound.

In order to calculate and detect the rotational angle of the rotatable shaft, it is necessary to obtain operating parameters such as resistance of wiring leading to the motor windings. The operating parameters such as the wiring resistance cannot be measured during operation of the pump. In a conventional control process in which windings of a motor are used for detecting a position of a rotatable shaft, a set point is inputted in accordance with length of wiring when the motor is wired, or a function for automatically measuring the resistance is provided so that the inverter automatically obtains the measured resistance when a user pushes a button immediately before the operation. A water supply apparatus utilizing a solar cell is likely to be operated while being unattended, and is always turned off at night. When solar radiation is insufficient because the sun is hidden by clouds, the water supply apparatus is turned off. In this manner, it is impossible to artificially set operating parameters each time the water supply apparatus is turned off. With a water supply apparatus according to the present invention, the controller 10 in the inverter has a program for automatically setting parameters each time before the pump 3 is started. Thus, the program is automatically executed when the pump is started, and the water supply apparatus does not cause any problems during unattended operation. Further, a user of the water supply apparatus is not required to pay attention to settings, and operating conditions are automatically set to be optimized.

If the motor pump 3 is started in a state such that electric power is not sufficiently supplied from the solar cell to the motor pump, then the pump may perform an inching operation in which the pump stops the moment it starts, and starts the moment it stops. Further, with respect to stopping of the motor pump 3, trouble may be caused unless the motor pump 3 is stopped in a state such that supplied power has a margin to a certain extent. If the supplied power is lowered, then an operating frequency of the pump is lowered, and a sufficient head cannot be maintained. As a result, although the pump is operated, a sufficient amount of water cannot be pumped up to the water storage tank 5. Therefore, conditions for starting and stopping the pump are predetermined as follows. Specifically, an open-circuit input voltage of the inverter 2 is monitored, and the pump is started when the open-circuit input voltage becomes not less than a predetermined value (e.g., 115 V) and is stopped when the input voltage V applied to the inverter is not more than a predetermined value (e.g., 90 V). Alternatively, the pump may be stopped when the frequency is not more than a predetermined value. A timer for stopping the pump can be set in a range from 0 to 60 seconds. In this manner, after the sun rises in the morning, the pump is started when the solar cell can generate an electric power equal to or larger than a predetermined value. When the electric power generated by the solar cell is lowered to a predetermined value or less by shade or sunset, the pump is stopped. It is desirable that the voltage for starting operation, the voltage for stopping operation, the frequency for stopping operation, and the like can properly be set to a desired value.

If the pump is operated such that the water level of the well is not sufficiently high and the pump is not submerged in the water, then the pump problematically races and burns out. Therefore, it is desirable to output an alarm or directly stop the pump before burnout of the pump. For example, a water level sensor may be provided in the well, and the pump may be stopped when the sensor detects water shortage. However, a sensor provided in a narrow well, in addition to the pump, requires difficult work and causes problems in terms of maintenance. Therefore, it is desirable that a racing operation of the pump be detected without a water level sensor.

Generally, when a pump races, a load is extraordinarily reduced because the pump does not work to pump up water. Accordingly, if an operating current of the pump is detected, and a minimum load current (shutoff current) is predetermined and stored in the controller of the inverter, then it can be judged that the pump races when the operating current is lower than the predetermined value. However, in a system in which an operating frequency of the pump varies by tracking maximum electric power points, it is difficult to determine a single minimum load current, and thus it is difficult to detect water shortage only based on electric current. According to the present invention, setting current values for judging water shortage are predetermined for each of the operating frequencies. The operating frequency is first detected, then a setting current value is read out based on the operating frequency, and the setting current value is compared with an actual present current value to thereby judge water shortage. Thus, even if the operating frequency varies, water shortage can properly be judged to forestall a burnout accident of the pump.

Figure 2:
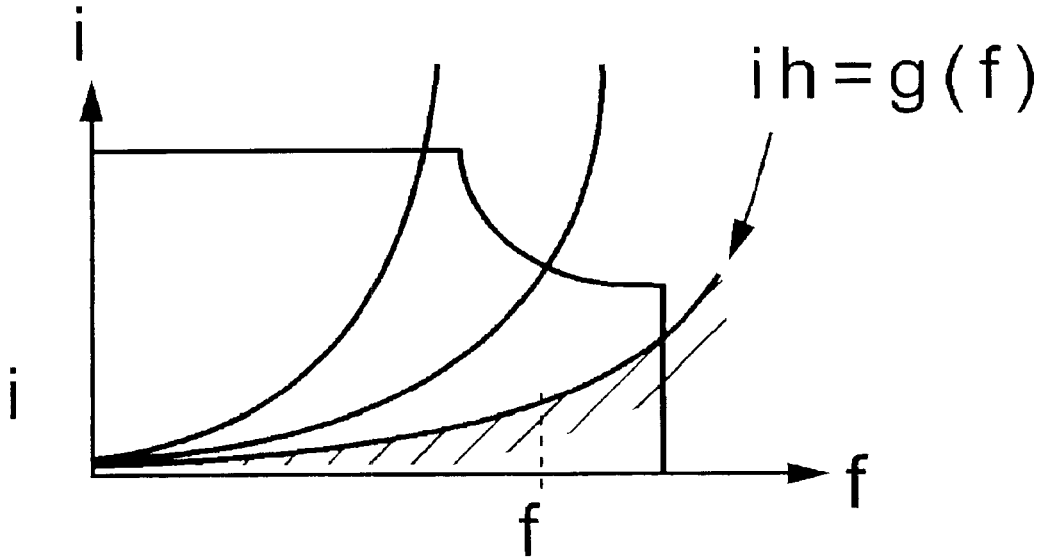
FIG. 2 is a graph of curves to judge racing of a motor pump, with the horizontal axis representing an output frequency f, and the vertical axis representing an output current i.

The DC brushless motor has a relationship between output frequencies and output currents as shown in FIG. 2, and curves shown in FIG. 2 are substantially quadric curves. Therefore, formulas of these curves may be stored, or a finite number of frequencies and currents corresponding thereto may be stored while being associated with each other. In this case, when a value of a detected frequency is between discretely stored values, it is desirable to correct the value with use of a linear approximation or the like. Specifically, the curves to judge racing of the pump are expressed by $$ih=g(f)$$

The curves represent load characteristics at a time of minimum load (no-load state). Based on these curves, a minimum output current i which corresponds to frequency f is calculated. When an actual current value, which is measured, is equal to or lower than a current ih for judging racing of the pump at all times, the pump is stopped, an alarm indicating water shortage is outputted, and an LED lamp is turned on. Resetting conditions include resetting by a button, shutting down power supply, restarting the pump after stopping conditions have been satisfied, and waiting 30 minutes after the alarm has been stopped.

Such a pumping system utilizing a solar cell is likely to be installed at a site where maintenance and inspection cannot sufficiently be performed. Water shortage may be improved according to passage of time. If the pump automatically returns to a normal status, then it is possible to avoid a malfunction in that water cannot be pumped up because the pump is stopped for a long time. Even if the pump is stopped by detecting an abnormality and an alarm is outputted, the controller in the inverter automatically releases the alarm and restarts the pump after a certain period of about 30 minutes elapses. When the inverter is turned off by temporary shade, the pump is also reset as described above.

Although a solar cell is utilized as a power source in the embodiment described above, wind power generation or the like may also be used as a power source. Alternatively, the pump may be connected to a power supply such as a battery instead of the solar cell. Thus, various changes and modifications may be made in the present invention without departing from the scope thereof.

As described above, according to the present invention, with a DC brushless motor, efficiency of the entire system can be improved, and solar energy can efficiently be utilized. Further, since the pump is operated at a higher speed with the inverter, the pump can be made small and lightweight and can be easily fitted into a narrow well, so that the system can be made easy to use. Since a rotational angle of the DC brushless motor is detected without any external sensors such as Hall element sensors, it is not necessary to provide any sensors and wires around the motor pump, so that the pump can easily be installed in a narrow well and can easily be maintained.

Since operating parameters, including wiring resistance of a cable of the DC brushless motor, are automatically set when the pump is started, the motor pump can automatically be tuned based on the operating parameters, thereby eliminating trouble in setting the operating parameters and trouble caused by forgetting to set the operating parameters. Further, since setting current values for detecting racing of the pump are predetermined for each of rotational speeds of the operating pump in the controller of the inverter and are compared with actual current values, it is possible to detect a racing operation of the pump due to water shortage in a well, thereby forestalling burnout of the pump. Since the inverter has a program for automatically returning to a normal status after the pump has been stopped in an abnormal state with an alarm being outputted, the pump is prevented from remaining stopped.

Figure 3:
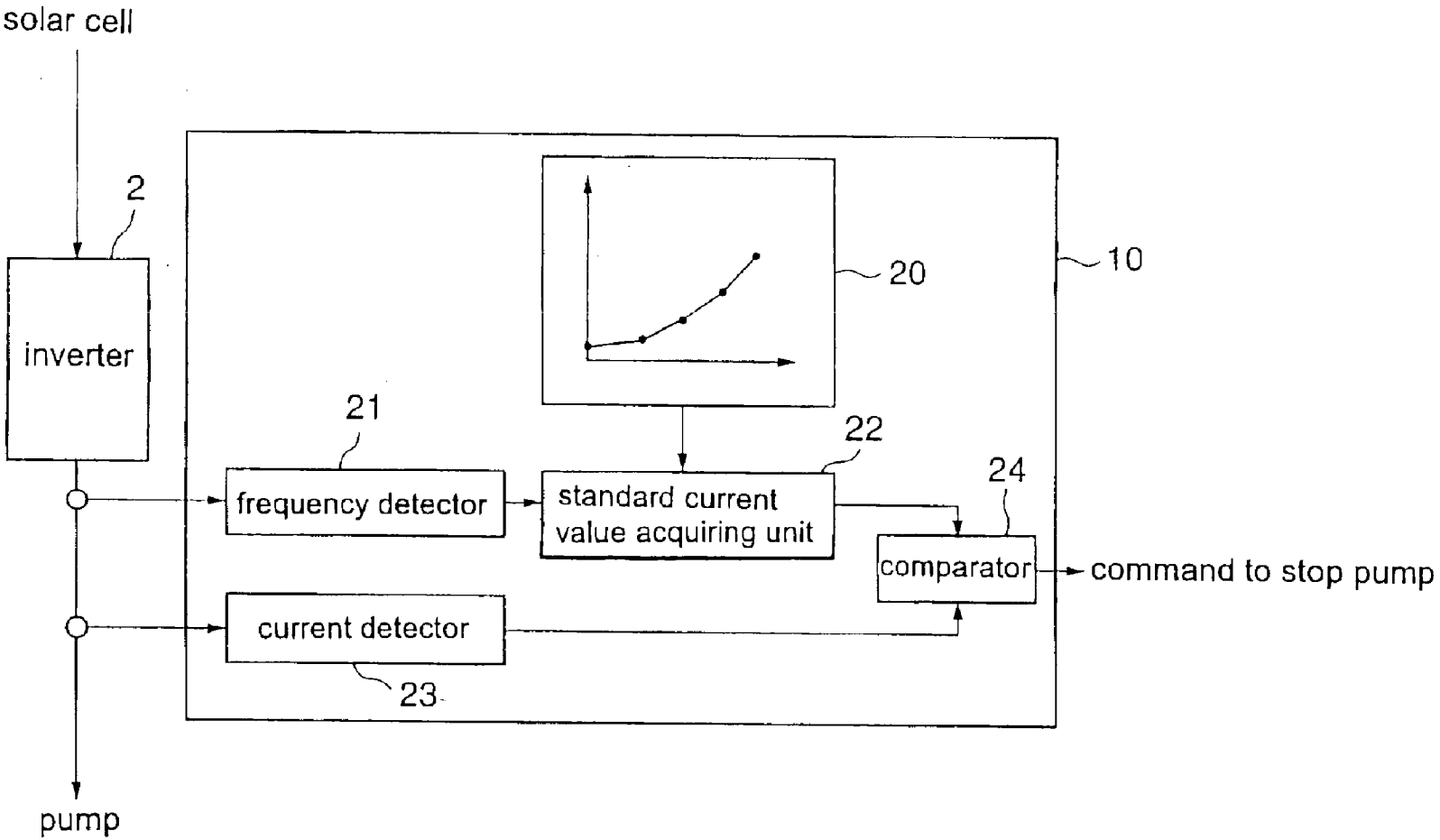
FIG. 3 is a block diagram showing an arrangement of a controller shown in FIG. 1.

FIG. 3 is a block diagram explanatory of preventing a shutoff operation in a water supply apparatus according to the present invention.

Figure 4:
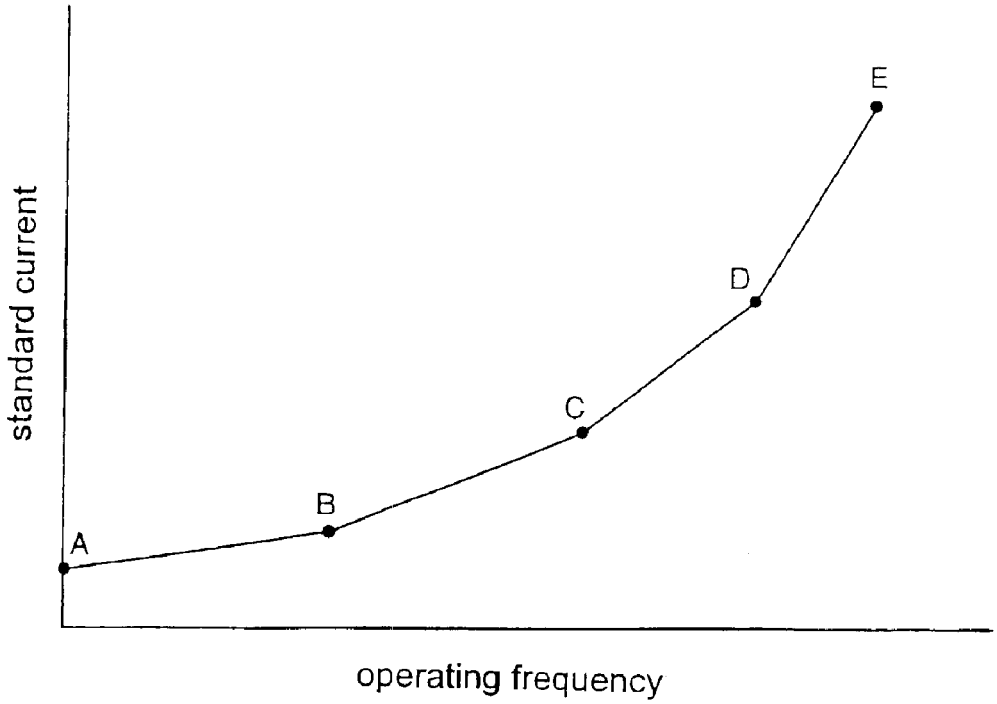
FIG. 4 is a graph showing an example of a standard current value table stored in the controller shown in FIG. 3.

Generally, when a pump performs a shutoff operation, a load is extraordinarily reduced because the pump does not work to pump water. Accordingly, if a minimum load current (shutoff current) is predetermined, then it can be judged that the pump performs a shutoff operation when an operating current is lower than a predetermined value. Because a shutoff current value varies according to rotational speed (operating frequency) of the pump, shutoff current values should be predetermined for each of rotational speeds. In the present embodiment, a storage device (not shown) provided in the controller 10 has a standard current value table 20 stored therein associating operating frequencies of the pump and standard current values (shutoff currents) as criteria for performing the shutoff operation at corresponding frequencies with each other. For example, as shown in FIG. 4, combinations of operating frequencies of the pump and standard current values at five points (A, B, C, D, and E) are prepared, and a standard current value table in which lines or the like are interpolated between the respective points is used.

As shown in FIG. 3, the controller 10 comprises a frequency detector 21 for detecting a frequency of a secondary current of the inverter 2, i.e., an operating frequency of the pump, a standard current value acquiring unit 22 for acquiring a standard current value which corresponds to the frequency detected by the frequency detector 21 with reference to the standard current value table 20, a current detector 23 for detecting a current value of a secondary current of the inverter 2, i.e., a current value of the motor in the pump 3, and a comparator 24 for comparing the current value detected by the current detector 23 and the standard current value acquired by the standard current value acquiring unit 22.

Further, a first preset time as a period of time until the pump is stopped in a case of performing a shutoff operation, and a second preset time as a period of time from the time when the pump is stopped until the pump is restarted, are prestored in the storage device of the controller 10. The first preset time should be shorter than a period of time in which the pump is damaged by overheat due to performing the shutoff operation of the pump. Because the degree of overheat due to performing the shutoff operation becomes higher as a rotational speed of the pump becomes larger, the first preset time may be set for each of the rotational speeds so that the first preset time is shorter when the rotational speed is larger, for example. On the other hand, the second preset time should be long enough to cool the pump, overheated to a certain extent.

Figure 5:
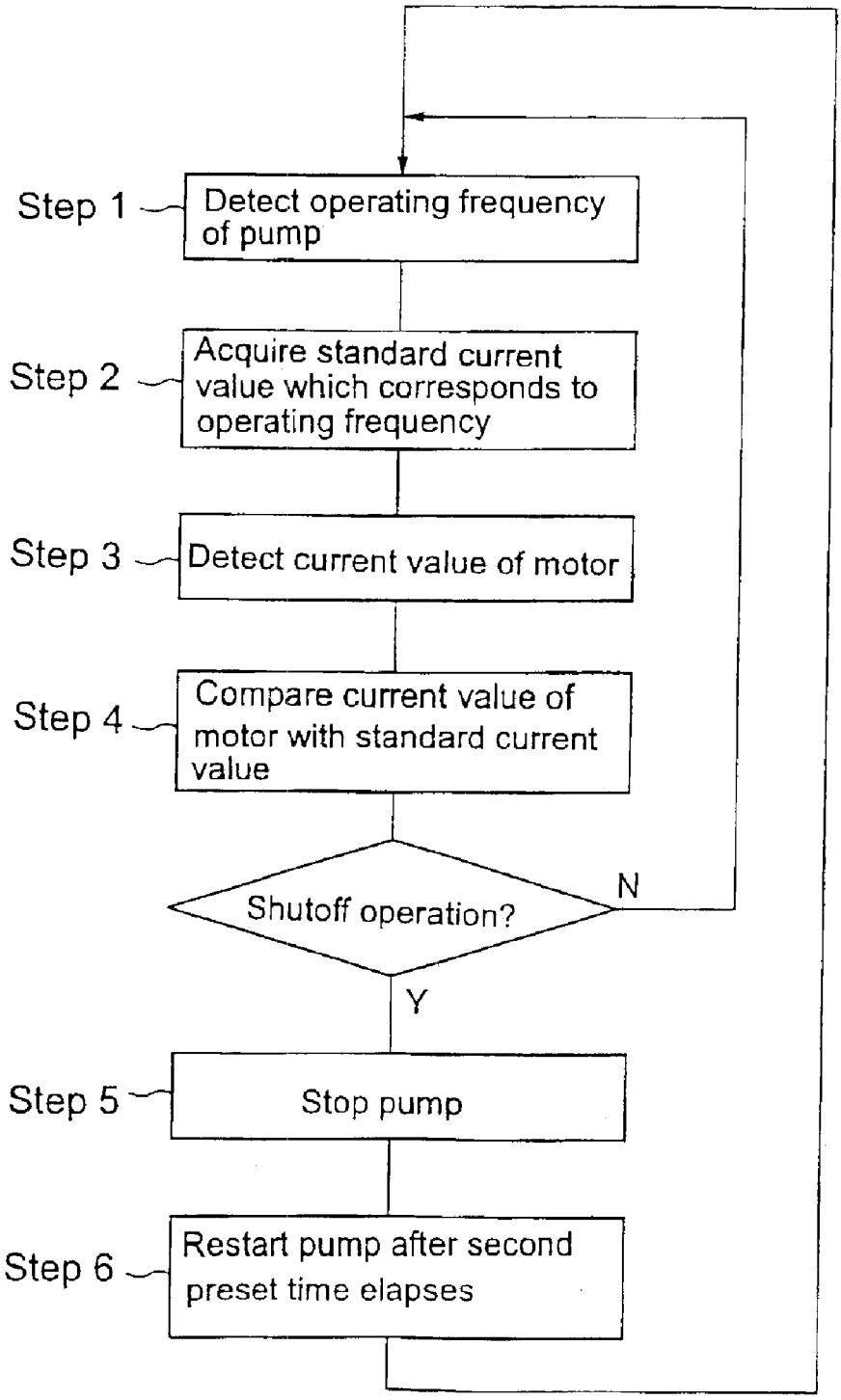
FIG. 5 is a flow chart showing operations of a water supply apparatus according to an embodiment of the present invention.

Next, operation of a water supply apparatus according to the present invention will be described below. FIG. 5 is a flow chart showing an operation for preventing performance of a shutoff operation of a water supply apparatus.

While the water supply apparatus is operated, a frequency of a secondary current of the inverter 2 is detected by the frequency detector 21 in the controller 10 (Step 1). The standard current value acquiring unit 22 refers to the standard current value table 20 to acquire a standard current value which corresponds to this detected frequency (Step 2).

Next, a current of the motor in the pump 3 is detected by the current detector 23 (Step 3), and the detected current is compared with the standard current value in the comparator 24 (Step 4). When the current value of the motor is lower than the standard current value, and the state in which the current value of the motor is lower than the standard current value is maintained for a period longer than the first preset time, it is judged that the pump is in a shutoff operation and the pump is stopped (Step 5). In this case, an alarm may be displayed by turning on an LED lamp or the like, for example. Thus, according to the present invention, since a shutoff operation of the pump can be detected to thereby stop the pump, the pump is prevented from being damaged by overheat due to the shutoff operation.

Such shutoff operation occurs in a case of extremely particular solar radiation. Since the solar radiation periodically changes, it is expected that a sufficient amount of solar radiation can be obtained over time. Further, maintenance and inspection are difficult to be performed in stock farms which require such a water supply apparatus utilizing a solar cell, and a maintenance free apparatus is required for such stock farms.

In the present embodiment, the pump automatically returns to the normal status after the pump is stopped as described above. In the present embodiment, the pump is stopped when the shutoff operation is detected, and after the second preset time elapses, the pump automatically returns to the normal status and is restarted (Step 6). In this manner, since the pump automatically returns to the normal status, a maintenance free apparatus can be achieved. Accordingly, the water supply apparatus does not cause any problems during unattended operation, and insufficient water storage is prevented from being caused by long-term stoppage of the pump.

Figure 6:
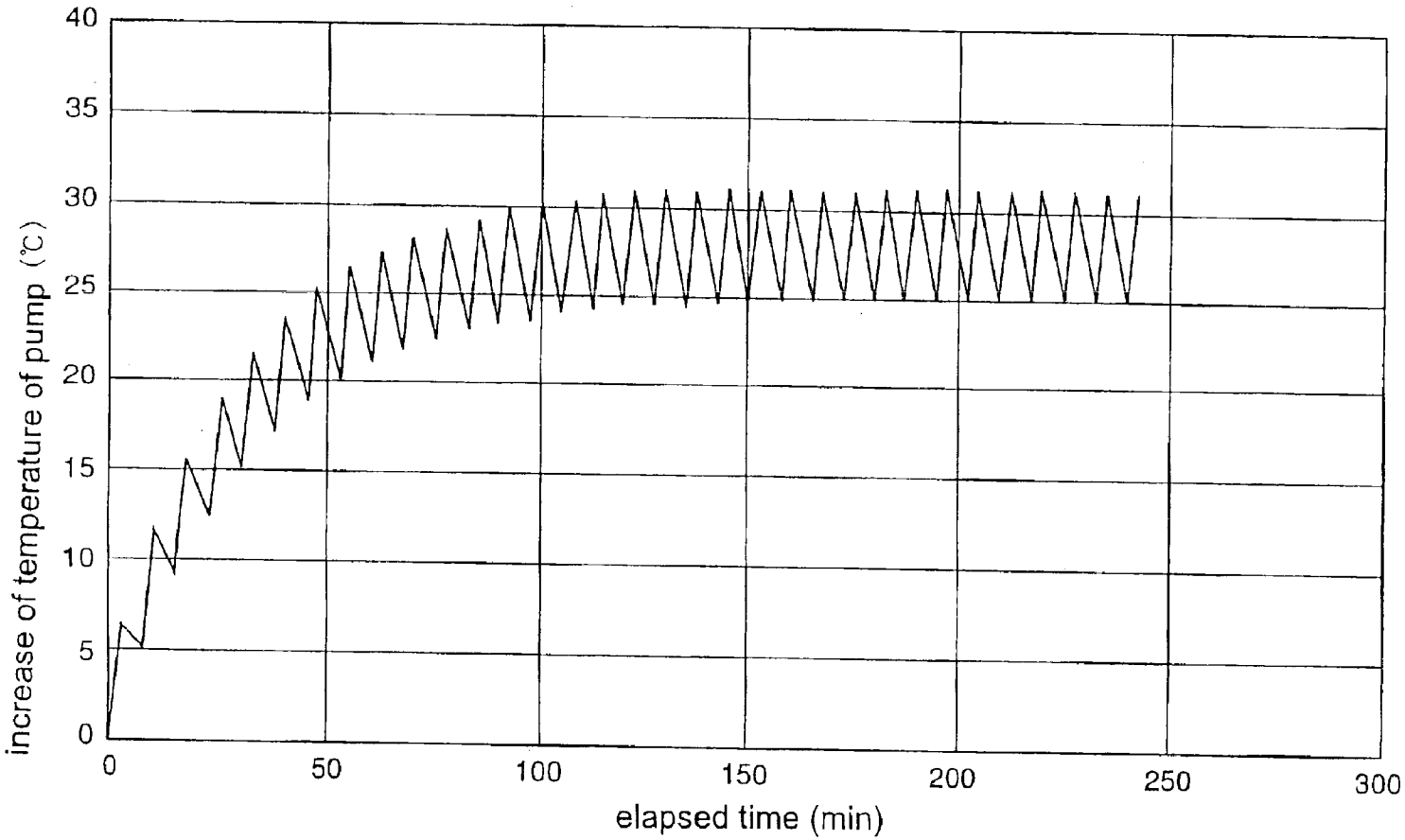
FIG. 6 is a graph showing changes of increase of the temperature of a pump when a shutoff operation is detected in a water supply apparatus according to the present invention.

FIG. 6 is a graph showing changes of increase of the temperature of the pump when the shutoff operation is detected as described above. In the example shown in FIG. 6, the first preset time is set to be 2 minutes 30 seconds, and the second preset time is set to be 5 minutes. As shown in FIG. 6, the pump is stopped after the first preset time, and temperature of the pump is lowered. Then, the pump is restarted after the second preset time, and temperature of the pump is increased. If a shutoff operation continues, then the above operation is repeated to increase and lower the temperature of the pump, but the temperature of the pump becomes not more than a predetermined value. Thus, by properly setting the first preset time and the second present time, the pump is prevented from being overheated to a temperature equal to or higher than a predetermined value.

While the present invention has been described with reference to an embodiment thereof, many modifications and variations may be made in the present invention without departing from the spirit and scope thereof.

As described above, since a shutoff operation can be detected during operation of the pump for thereby stopping the pump, it is possible to prevent the pump from being damaged by overheat due to the shutoff operation.

Further, since the water supply apparatus can achieve maintenance free operation, the water supply apparatus does not cause any problems during unattended operation, and insufficient water storage is prevented from being caused by long-term stoppage of the pump.

INDUSTRIAL APPLICABILITY

The present invention relates to a water supply apparatus having a pump operated at variable speeds with a frequency converter such as an inverter. Particularly, the present invention is suitable for use in a water supply apparatus for converting output power of a solar cell with an inverter and supplying the electric power to a motor pump disposed at a bottom of a well or the like to pump up water. The present invention allows feeding of water, irrigation, and the like to be performed even in regions to which stable electric power cannot easily be supplied, such as intermontane regions, and thus is highly useful for such regions. The present invention can industrially be employed effectively as a water supply apparatus for such purposes.

What is claimed is:

1. A water supply apparatus comprising:

an inverter for converting power output from a solar cell;

a DC brushless motor for receiving converted power from said inverter so as to drive a pump such that water is pumped, said DC brushless motor having no sensor for detecting a position of a rotatable shaft;

means for measuring an operating parameter so as to provide a measured operating parameter; and means for automatically setting the measured operating parameter.

2. The water supply apparatus according to claim 1, wherein said inverter includes means for detecting a racing operation of the pump based on a set current value for each operating frequency.

3. The water supply apparatus according to claim 2, wherein said means for measuring an operating parameter comprises means for measuring resistance of wiring from said inverter to said DC brushless motor such that said means for automatically setting the measured operating parameter comprises means for automatically setting a measured resistance of the wiring from said inverter to said DC brushless motor.

4. The water supply apparatus according to claim 1, wherein said means for measuring an operating parameter comprises means for measuring resistance of wiring from said inverter to said DC brushless motor such that said means for automatically setting the measured operating parameter comprises means for automatically setting a measured resistance of the wiring from said inverter to said DC brushless motor.

5. A water supply apparatus comprising:

a solar cell;

an inverter for converting a direct-current output of said solar cell to an alternating-current output and supplying the alternating-current output to a DC brushless motor having no sensor for detecting a position of a rotatable shaft;

a pump to be driven by said DC brushless motor;

a water storage tank for temporarily storing water that is to be pumped by said pump; and a controller, having a start condition and a stop condition for said pump, for automatically causing said pump to be driven based on the start condition and the stop condition.

6. The water supply apparatus according to claim 5, wherein said inverter and said controller are at ground level, said pump and said DC brushless motor are within a well, and said inverter and said DC brushless motor are interconnected only by cable wiring for supplying the alternating-current output to said DC brushless motor.

7. The water supply apparatus according to claim 6, wherein said controller is for automatically causing said pump to be driven based on the start condition and the stop condition by (i) causing said pump to be started when electric power capable of being generated by said solar cell is greater than a predetermined value, and (ii) causing said pump to be stopped when electric power generated by said solar cell is less than a predetermined value.

8. The water supply apparatus according to claim 5, wherein said controller is for automatically causing said pump to be driven based on the start condition and the stop condition by (i) causing said pump to be started when electric power capable of being generated by said solar cell is greater than a predetermined value, and (ii) causing said pump to be stopped when electric power generated by said solar cell is less than a predetermined value.

9. A water supply apparatus comprising:

standard current value acquiring means for acquiring a standard current value as a criterion for a shutoff operation of a pump;

current detecting means for detecting value of a current supplied to the pump;

means for comparing the value of the current supplied to the pump with the standard current value as acquired by said standard current value acquiring means so as to determine whether the pump is in the shutoff operation; and means for stopping the pump after a first certain period of time when it is determined that the pump is in the shutoff operation.

10. The water supply apparatus according to claim 9, wherein said means for stopping the pump after a first certain period of time when it is determined that the pump is in the shutoff operation comprises means for automatically stopping the pump after a period of time that is less than a period of time which would result in overheating of the pump were the pump continued to be operated therefor.

11. The water supply apparatus according to claim 10, further comprising:

means for restarting the pump after a second certain period of time from when the pump is stopped.

12. The water supply apparatus according to claim 11, wherein said means for restarting the pump after a second certain period of time from when the pump is stopped comprises means for automatically restarting the pump after a period of time from when the pumped is stopped sufficient to cool the pump if overheated to a certain extent.

13. The water supply apparatus according to claim 9, further comprising:

mean for restarting the pump after a second certain period of time from when the pump is stopped.

14. The water supply apparatus according to claim 13, wherein said means for restarting the pump after a second certain period of time from when the pump is stopped comprises means for automatically restarting the pump after a period of time from when the pumped is stopped sufficient to cool the pump if overheated to a certain extent.

15. The water supply apparatus according to claim 13, wherein said means for stopping the pump after a first certain period of time when it is determined that the pump is in the shutoff operation comprises means for stopping the pump after the first certain period of time when it is determined, by said means for comparing, that the value of the current as detected by said current detecting means is less than the standard current value as acquired by said standard current value acquiring means.

16. The water supply apparatus according to claim 15, wherein said means for stopping the pump after the first certain period of time when it is determined, by said means for comparing, that the value of the current as detected by said current detecting means is less than the standard current value as acquired by said standard current value acquiring comprises means for stopping the pump after a period of time that is predetermined for each rotational frequency of the pump.

17. The water supply apparatus according to claim 16, further comprising:

a standard current value table in which rotational frequencies of the pump, and standard current values as criteria for the shutoff operation of the pump at the rotational frequencies, are associated with each other.

18. The water supply apparatus according to claim 13, further comprising:

a frequency converter for supplying electric power to the pump and controlling a rotational speed of said pump.

19. The water supply apparatus according to claim 13, further comprising:

a standard current value table in which rotational frequencies of the pump, and standard current values as criteria for the shutoff operation of the pump at the rotational frequencies, are associated with each other.

20. The water supply apparatus according to claim 13, wherein said means for stopping the pump after a first certain period of time when it is determined that the pump is in the shutoff operation comprises means for stopping the pump after a period of time that is predetermined for each rotational frequency of the pump.

* * * * *

UNITED STATES PATENT AND TRADEMARK OFFICE

CERTIFICATE OF CORRECTION

PATENT NO. : 6,922,348 B2
DATED : July 26, 2005
INVENTOR(S) : Kaoru Nakajima et al.

It is certified that error appears in the above-identified patent and that said Letters Patent is hereby corrected as shown below:

Title page,
Item [54], Title, change "WATER SUPPLY" to -- WATER SUPPLY APPARATUS --.

Signed and Sealed this

Eighth Day of November, 2005

JON W. DUDAS
*Director of the United States Patent and Trademark Office*